US006405882B1

(12) United States Patent
Baxter

(10) Patent No.: US 6,405,882 B1
(45) Date of Patent: Jun. 18, 2002

(54) TANK STORAGE CONTAINER

(76) Inventor: John D. Baxter, 2838 Watkins Dr., Melbourne, FL (US) 32901

( * ) Notice: Subject to any disclaimer, the term of this patent is extended or adjusted under 35 U.S.C. 154(b) by 0 days.

(21) Appl. No.: 09/505,095

(22) Filed: Feb. 16, 2000

(51) Int. Cl.[7] ..... A47G 29/00; B65D 21/02

(52) U.S. Cl. ..... 211/85.18; 220/23.83; 211/74

(58) Field of Search ..... 211/71.01, 85.18–85.23, 211/74–75, 13.1, 60.1; 224/406, 324, 325, 42.33, 42.38–42.39; 220/562, 564, 4.12, 4.04, 23.83, 23.87–23.88, 509; 206/446, 145, 150, 151, 203, 429, 430

(56) References Cited

U.S. PATENT DOCUMENTS

| | | | | | |
|---|---|---|---|---|---|
| 3,065,857 | A | * | 11/1962 | Sanders | |
| 3,791,403 | A | * | 2/1974 | Folkerth | 211/71.01 |
| 3,951,259 | A | * | 4/1976 | Oglesbee | 220/23.83 |
| 3,964,266 | A | | 6/1976 | Bartlett | 61/70 |
| 4,130,200 | A | * | 12/1978 | Iepson et al. | 206/446 |
| 4,168,007 | A | * | 9/1979 | Rohatensky | 211/71.01 |
| 4,290,529 | A | * | 9/1981 | Jones et al. | 211/13.1 |
| 4,495,883 | A | | 1/1985 | Hoy | 114/343 |
| 4,621,737 | A | * | 11/1986 | Casey | 211/71.01 |
| 4,773,348 | A | * | 9/1988 | Rowley | 211/85.18 |
| 4,871,099 | A | * | 10/1989 | Bogar, Jr. | 224/273 |
| 4,889,306 | A | | 12/1989 | Boucher | 248/313 |
| 4,899,968 | A | * | 2/1990 | Eaglin et al. | 211/71.01 |
| 5,025,935 | A | | 6/1991 | Hadachek | 211/71 |
| 5,082,464 | A | | 1/1992 | Clink | 440/6 |
| 5,127,531 | A | * | 7/1992 | Onodera | 211/74 |
| 5,148,932 | A | * | 9/1992 | Orefice | 220/23.2 |
| 5,267,815 | A | | 12/1993 | Feder | 405/186 |
| 5,299,721 | A | | 4/1994 | Cummings | 224/42.42 |
| 5,381,916 | A | * | 1/1995 | Strawder | 220/23.83 |
| 5,544,499 | A | * | 8/1996 | Boggs | 220/23.83 |
| 5,546,885 | A | * | 8/1996 | Porada | 224/42.33 |
| 5,609,282 | A | * | 3/1997 | Melanson | 224/583 |
| 5,788,475 | A | | 8/1998 | Henderson | 405/186 |
| 5,833,197 | A | | 11/1998 | Peabody | 248/346.01 |
| 5,901,890 | A | | 5/1999 | Stokes | 224/406 |
| 6,056,255 | A | * | 5/2000 | Meade | 211/85.18 |
| 6,109,581 | A | * | 8/2000 | Kracke et al. | 211/74 |
| 6,158,587 | A | * | 12/2000 | Emery | 206/446 |

OTHER PUBLICATIONS

Webpage Advertisement, Pelican Tank Racks, 1999.

* cited by examiner

*Primary Examiner*—Daniel P. Stodola
*Assistant Examiner*—Jennifer E. Novosad
(74) *Attorney, Agent, or Firm*—Law Offices of Brian S. Steinberger, P; Brian S. Steinberger

(57) ABSTRACT

Containment racks for safely storing cylinders such as diving tanks, welding tanks, and medical tanks such as oxygen tanks, in vertical upright positions. A first version has a holder container for supporting up to six tanks in two rows of three tanks per row. Each of the tanks are held in cylindrical hollow supports having an open upper end for inserting an individual tank therein. Another version uses cylinders side by side to one another in a straight line, and a still another version has four cylinder holders in a rectangular configuration. The rack devices can be used in different combinations to store three, four, five, six, seven and eight cylinders at one time. The rack devices can be formed from materials such as plastics, resin, glass, composites, fiberglass, combinations thereof, and the like. Each of the rack versions can include rectangular frames about a mid central portion having through-holes therein for allowing the racks to be tied down when being used in pickup truck beds and boats. Drain holes can also be incorporated in the rack devices to drain excess water. The racks can be additionally used in homes and garages.

17 Claims, 11 Drawing Sheets

TANK STORAGE CONTAINER

This invention relates to diving tanks, and in particular to three, four, five, six, seven and eight holder containers for separating and storing diving tanks in vertical upright positions side by side to one another, and for protecting the sides of the tanks from being damaged.

BACKGROUND AND PRIOR ART

Diving tanks such as scuba tanks contain pressurized air that can become hazardous if not properly stored or handled. Additionally, it is preferable that the scuba tanks be consistently transported and stored in a vertical position as opposed to a horizontal position. The horizontal position can cause damage, marring and scratches, thus increasing the likelihood of corrosion. Additionally, storing tanks in horizontal positions on their sides takes up an unnecessary waste of floor space. Merely storing the diving tanks in an upright position is not safe since the unsecured tanks can tip, fall over and hit against one another. Using rope and bungee cords is not a practical solution for storing loose tanks in pickup truck beds, garages, boats, dive shops and the like.

Divers have sometimes used their existing dive backpacks to store the cylinder tanks when the tanks are not being used. There are several problems with using the backpacks for storage. First, most backpacks do not have rigid structures for allowing the backpacks to be stored in a upright position on a floor surface. Secondly, backpacks usually only have room for storing up to two tanks. Many professional and sportsman divers normally take three or more tanks on a dive trip. The problem becomes compounded when plural divers go to a dive trip. In fact normal safety procedures require two divers teamed up with one another for a single dive.

The inventor is aware of several types of devices that can be used for storing dive tanks. See for example, U.S. Pat. No. 3,964,266 to Bartlett; U.S. Pat. No. 4,495,883 to Hoy; U.S. Pat. No. 4,889,306 to Boucher; U.S. Pat. No. 5,025,935 to Hadachek; U.S. Pat. No. 5,082,464 to Clink; U.S. Pat. No. 5,267,815 to Feder; U.S. Pat. No. U.S. Pat. No. 5,299,721 to Cummings; U.S. Pat. No. 5,788,475 to Henderson; U.S. Pat. No. 5,833,197 to Peabody; and U.S. Pat. No. 5,901,890 to Stokes. However, none of these devices singularly or in combination overcomes all of the problems described above. A device sold under the name "Pelican Tank Racks" shows racks for holding four and six air tanks. However, the Pelican Tank Racks require using "carbon steel" that is wrapped in polyester coating layer into large wire cages having large mesh opening. The coating layer can come off during normal wear and tear causing the steel underbody cage to rust and corrode. Additionally, the large mesh openings can still allow the tanks stored within the cage to hit and abut against one another. Thus, the large mesh openings in the Pelican Tank Racks do not fully protect the sidewalls of the tank.

SUMMARY OF THE INVENTION

The first objective of the present invention is to provide a tank storage container for storing up to three, four, five, six, seven and eight cylinder tanks in one container.

The second object of this invention is to provide a tank storage container that can store cylinder tanks in vertical upright positions side by side in a close configuration without abutting one another. The third object of this invention is to provide a tank storage container that does not oxidize, rust, and/or electrolytically corrode.

The fourth object of this invention is to provide a tank storage container that can be used with a boat.

The fifth object of this invention is to provide a tank storage container that can be used in a vehicle such as the bed of a truck, jeep, SUV, station wagon, and the like.

The sixth object of this invention is to provide a tank storage container that can be used in home or garage.

The seventh object of this invention is to provide a tank storage container that allows individual tanks to be easily accessible for cleaning and maintenance.

A preferred embodiment of the tank storage container for storing air tanks in vertical upright positions side by side to one another, includes a first cylindrical holder having a bottom closed end and an upper open end, a second cylindrical holder having a bottom closed end and an upper open end, the second cylindrical holder side by side and parallel to the first cylindrical holder, a third cylindrical holder having a bottom closed end and an upper open end, the third cylindrical holder being side-by-side and parallel to the second cylindrical holder, and a fourth cylindrical holder having a bottom closed end and an upper open end, the fourth cylindrical holder being side-by-side and parallel to the first cylindrical holder and the third cylindrical holder, wherein the first, the second, the third, and the fourth cylindrical holders can store cylindrical air tanks in vertical positions adjacent to one another and substantially protected from one another. The four cylindrical containers can be arranged side by side in a straight line. Alternatively, the four cylindrical containers can be arranged in a square four pack arrangement.

Another version of the tank storage container further includes a fifth cylindrical holder having a bottom closed end and an upper open end, the fifth cylindrical holder being side-by-side and parallel to the third cylindrical holder, and a sixth cylindrical holder having a bottom closed end and an upper open end, the sixth cylindrical holder being side-by-side and parallel to the fourth and fifth cylindrical holder. All six cylindrical holders can be arranged in two parallel rows of three holders per row, in a rectangular configuration.

The four and six containers each include a rectangular frame portion for fitting about an outside mid-center perimeter location of the fourth cylindrical holders. The rectangular frame portion and include mounting through-holes for allowing cords such as tiedown straps, bungee cords, and the like, to be inserted into the through-holes for fastening the tank storage container to boats, pickup truck beds, and the like.

The holders can be formed from a mold using materials such as plastics, resin, glass, composites, fiberglass, and combinations thereof, and the like. Each of the holders can include a top half portion and a bottom half portion. The top half portion having a rectangular frame at one end, and the bottom half portion having a rectangular frame at one end, where the frames can be fastened together by welding, fastening connections, straps, and the like. Each of the cylindrical half portions can have a slight conical shape. Alternatively, other methods of assembly can be done such as but not limited to forming the top and bottom half portions from one single piece. Additional features such as drain holes can be used separately and/or in combination with the mounting through-holes. Furthermore, permanently mounted fasteners such as but not limited to flat countersunk fasteners can be used instead of the mounting through-holes.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 2:
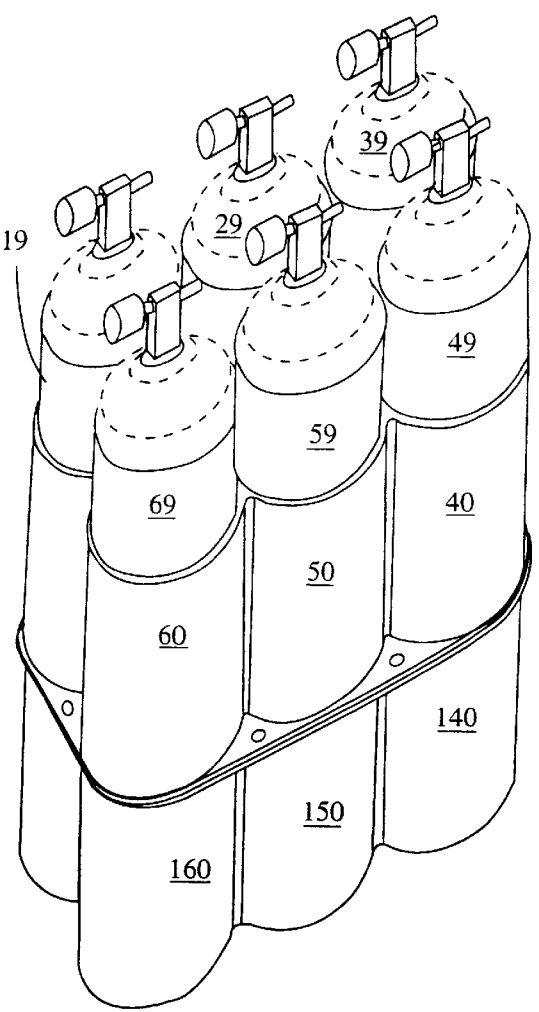
FIG. 2 is a perspective view of the tank storage container of FIG. 1 with tanks inserted into it.
Figure 1:
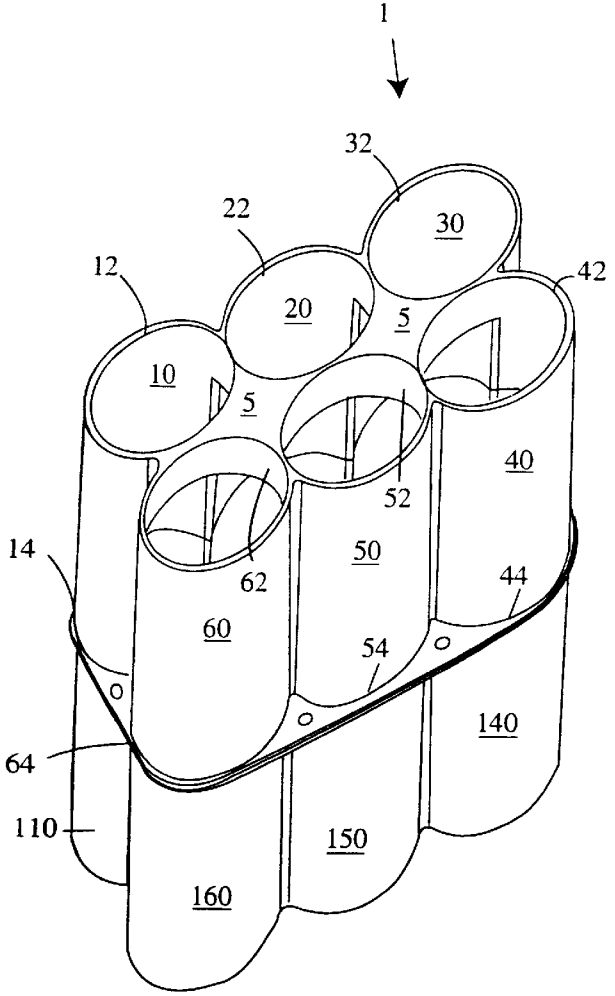
FIG. 1 is a perspective view of the novel tank storage container without tanks.
Figure 3:
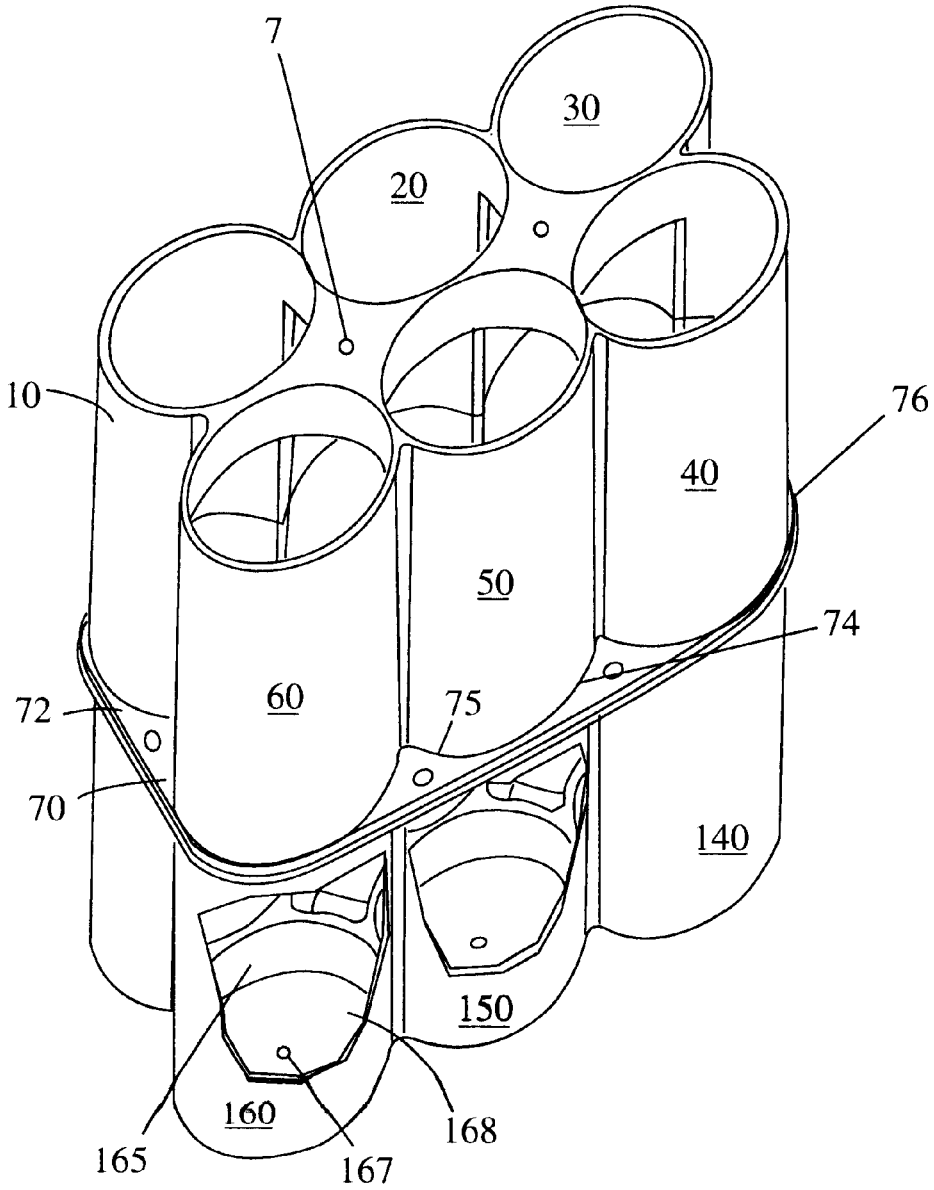
FIG. 3 is a perspective view of the tank storage container of FIG. 1 with a side-cutout.
Figure 4:
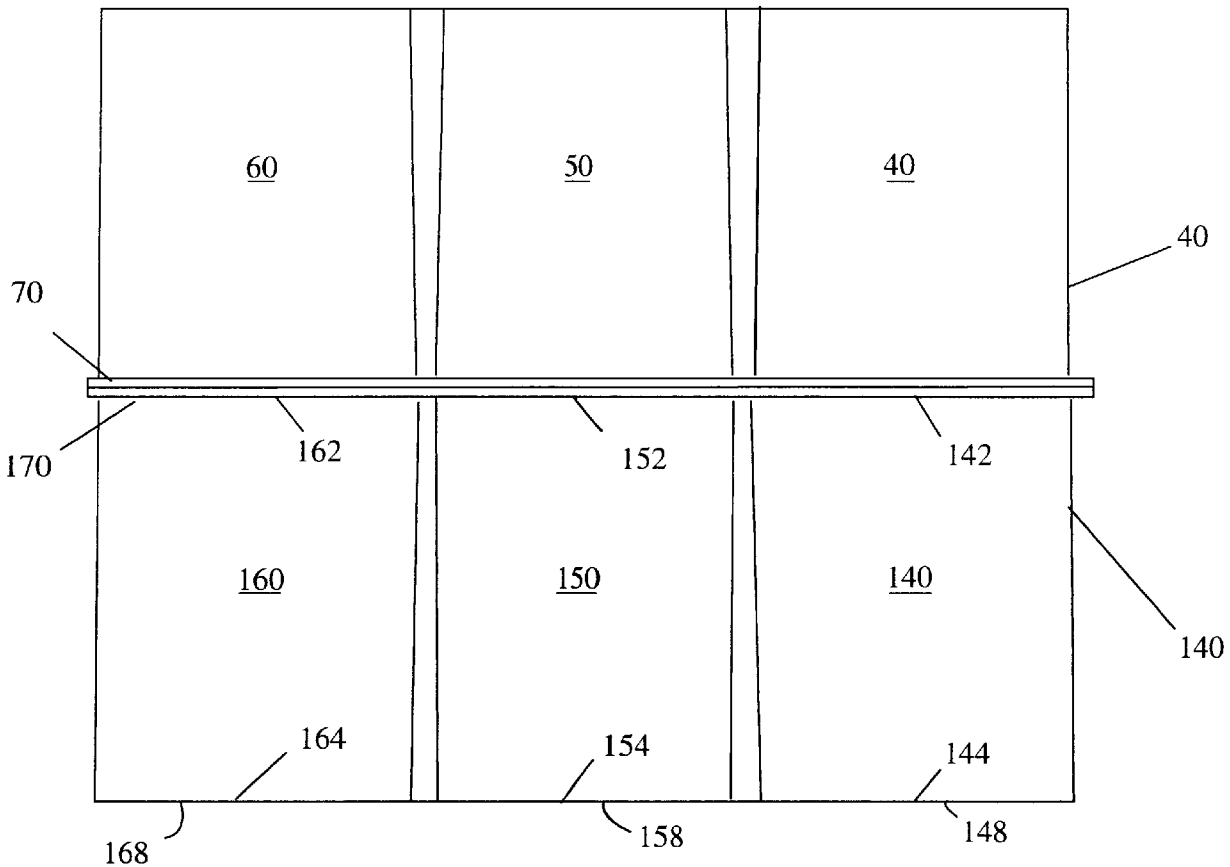
FIG. 4 is a side view of the tank storage container of FIG. 1 along arrow X.
Figure 5:
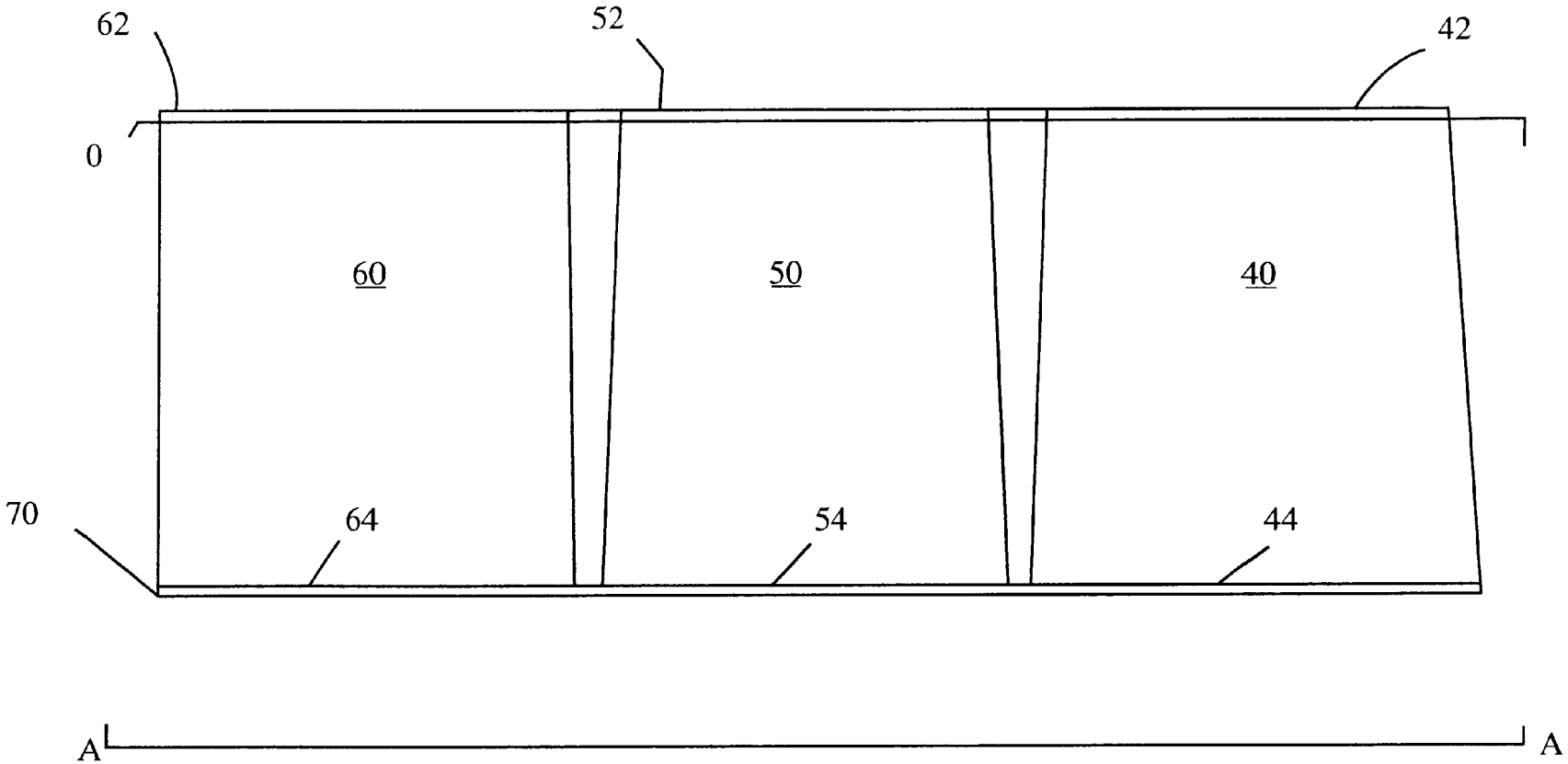
FIG. 5 is a side view of a top half section of the tank storage container of FIG. 4.
Figure 6:
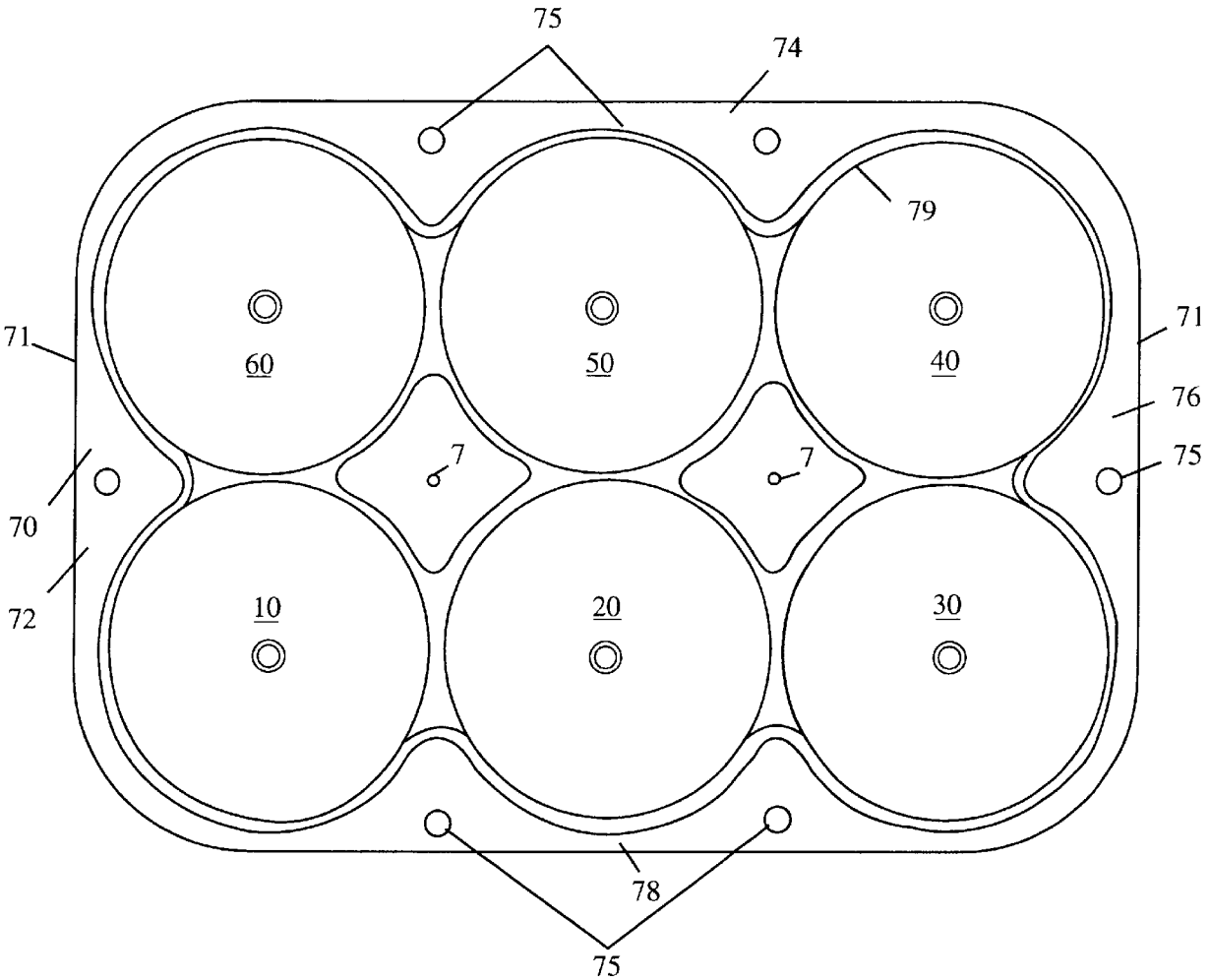
FIG. 6 is a bottom view of the top half section of FIG. 5 along arrow A—A.
Figure 7:
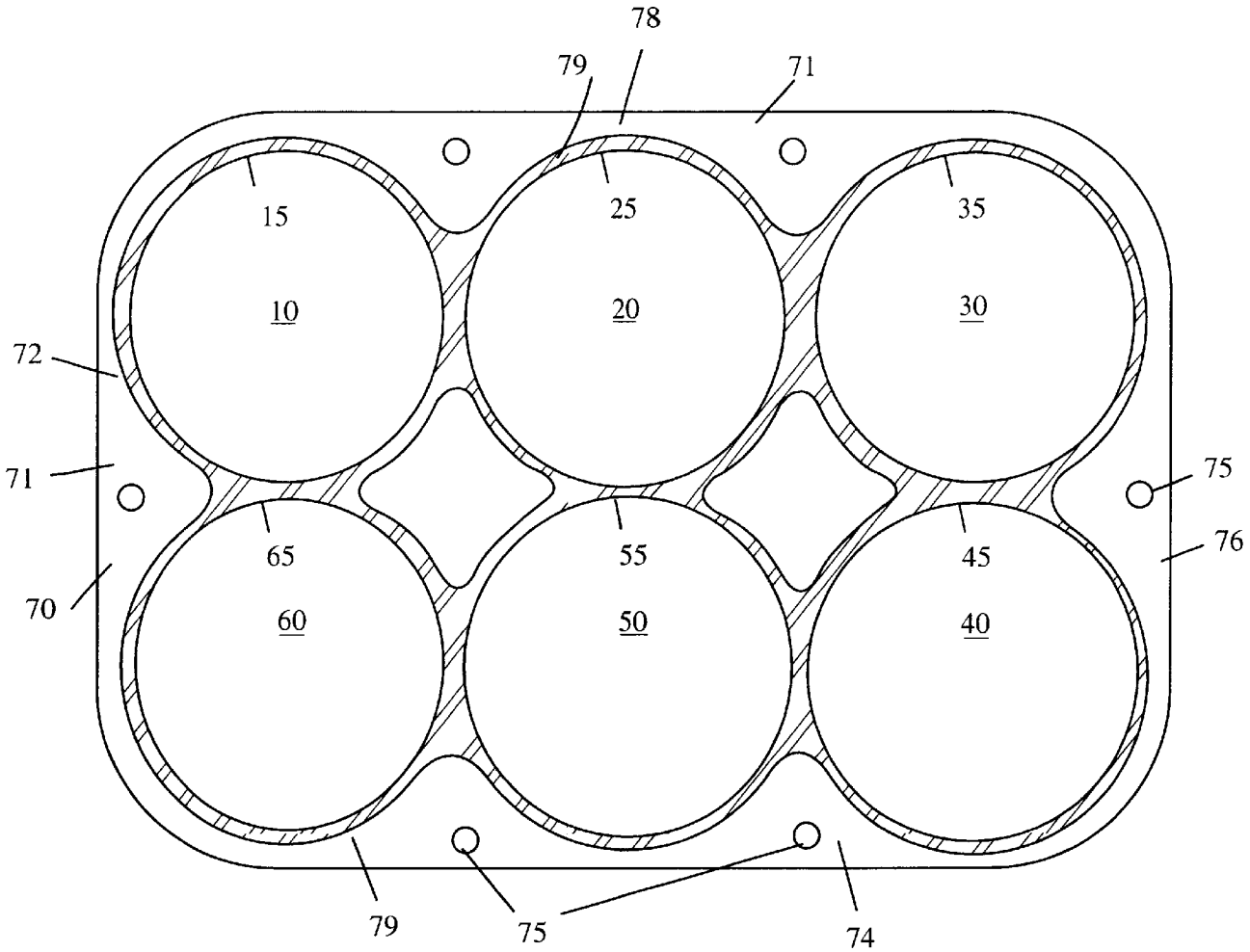
FIG. 7 is a top cross-sectional view of the top half section of FIG. 5 along arrow B—B.

FIG. 1 is a perspective view of the novel tank storage container 1 without tanks. FIG. 2 is a perspective view of the tank storage container 1 of FIG. 1 with tanks inserted into it. FIG. 3 is a perspective view of the tank storage container 1 of FIG. 2 with a side-cutout. FIG. 4 is a side view of the tank storage container 1 of FIG. 1 along arrow X. FIG. 5 is a side view of a top half section 60, 50, 40 of the tank storage container 1 of FIG. 4. FIG. 6 is a bottom view of the top half section of FIG. 5 along arrow A—A. FIG. 7 is a top cross-sectional view of the top half section of FIG. 5 along arrow B—B.

Referring to FIGS. 1–8, container 1 includes a top half portion having six cylinder portions 10, 20, 30, 40, 50, 60, each having top open circular openings 12, 22, 32, 42, 52, 62 having an upper diameter. The sides of the cylinders 10–60 are slightly conical shaped with larger lower end diameter portions 44, 54, 64(only three are shown) than the upper first diameter. Inside of each of the cylinders 10–60 are interior curved walls 15, 25, 35, 45, 55, 65, respectively that are sized for supporting up to six individual storage diving tanks 19, 29, 39, 49, 59, 69 therein.

A top rectangular frame portion 70 is attached about the lower end portions of the cylinders 10–60, and has an outer rectangular perimeter 71, and an inner curved edge 79 which wraps about and passes into the side grooved surfaces of the exterior of the lower end portions of cylinders 10–60. Rectangular frame 70 has two short sides 72, 74 which each wraps about two cylinders 10, 60 and 30, 40. And frame 70 has two long sides 76, 78 which each wraps about three cylinders 40, 50, 60 and 10, 20, 30. Through-holes 75 pass through each of the sides 72, 74, 76 and 78. The corner edges of rectangular frame 70 can be rounded.

Referring to FIGS. 1–8, container 1 includes a bottom half portion having six cylinders 110, 140, 150, 160(only four of which are shown) which are underneath each of the top half portion cylinders 10–60 described above. Each of the bottom half cylinders 110–160 have similar dimensions to that of the upper half portion cylinders 10–60 except that their upper ends 142, 152, 162(only three of which are shown have larger outer diameters than the lower diameter ends 144, 154, 164(only three of which are shown). The insides of bottom half cylinders 110–160 have hollowed out curved interior walls similar to the upper half cylinders 10–60. The bottom half cylinders 110–160 have floor portions 148, 158, 168(only three of which are shown) for supporting the bottoms of tanks 19, 29, 39, 49, 59, 69.

Attached to an upper ends 142, 152, 162 of bottom half portion cylinders 110–160 by welding, and the like, is another rectangular frame portion 170 which is identical to top rectangular frame portion 70. The upper half portion cylinders 10–60 can be pre-attached to upper rectangular frame portion 70, so that the entire upper half portion and upper rectangular frame 70, and be welded to the lower half portion cylinders 110–160 and its' rectangular frame, the latter of which have also been pre-attached to one another. The upper half portion and lower half portion and their respective rectangular frames can be formed from injection molded hardened plastic and the like.

Referring to FIGS. 1 and 6, the invention can include drain holes 7 that allow water to pass from the top of the container and out the bottom end. Additionally, each of the cylinder bottom half portions 110–160 can include drainage holes through their bottoms(only one 167 being shown). The drainage holes can also be used as the mounting through-holes for fastening the container 1 down.

Figure 8:
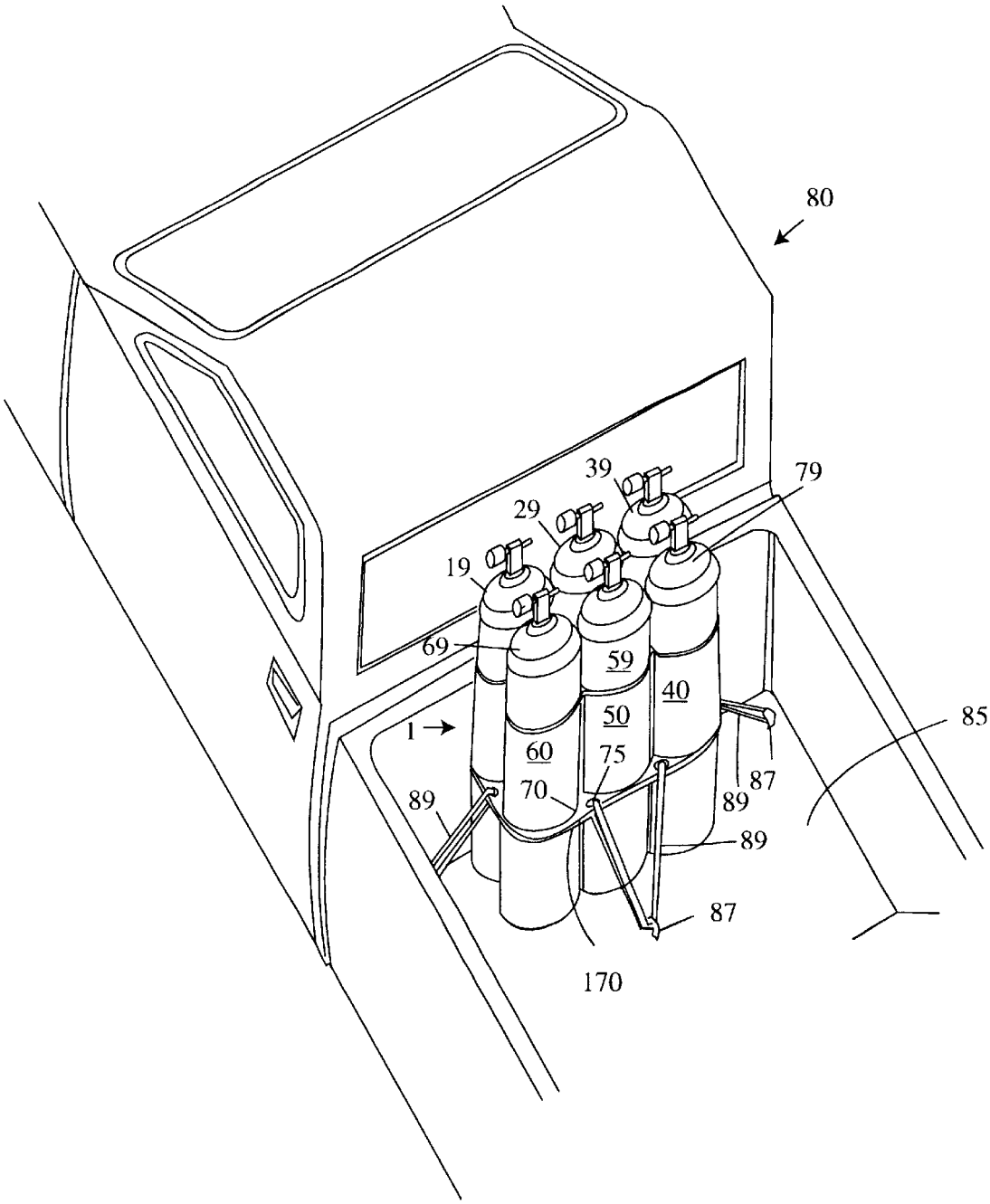
FIG. 8 shows the novel six tank container of the previous figures being used in the bed of a pickup truck.

FIG. 8 shows the novel six tank container 1 of the previous figures being used in the bed 85 of a pickup truck 80 where straps 89 such as bungee cords can be used to pass through the several through-holes 75 in the rectangular frames 70, 170 to hold the container 1 to clips 87 located on the bed floor 85 of the pickup truck 80. Note that the upper valve ends of the diving tanks 19, 29, 39, 49, 59, 69 are exposed so that any of the tanks can be pulled without touching an adjacent tank(s).

Figure 9:
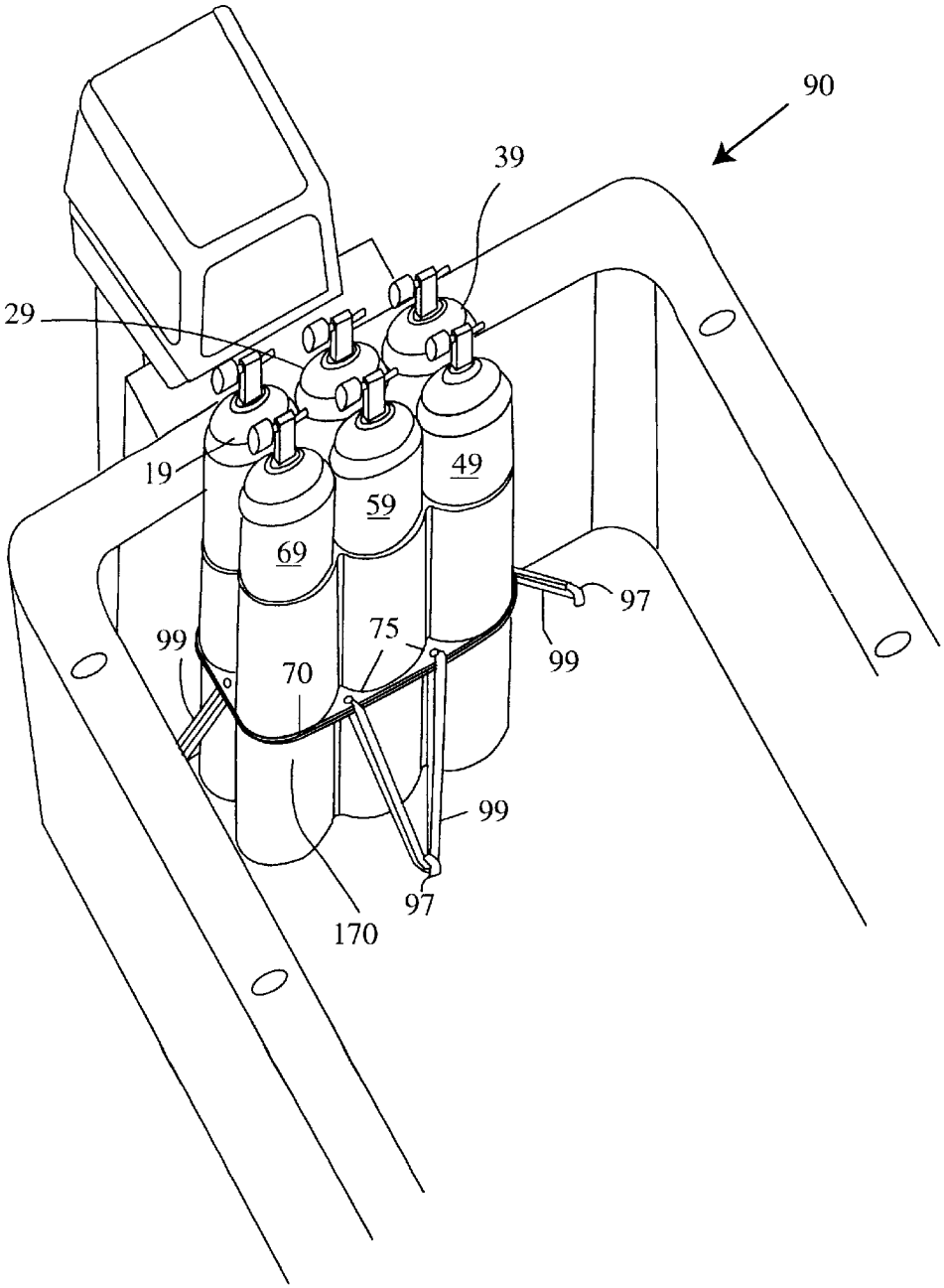
FIG. 9 shows the novel six tank container of the previous figures being used in a pleasure boat.

FIG. 9 shows the novel six tank container 1 of the previous figures being used within a pleasure boat 90 where straps 99 such as bungee cords, can be used to pass into the through-holes 75 in the rectangular frames 70, 170 to hold the container 1 stationary to adjacent cleats 97 on the boat 90.

Figure 11:
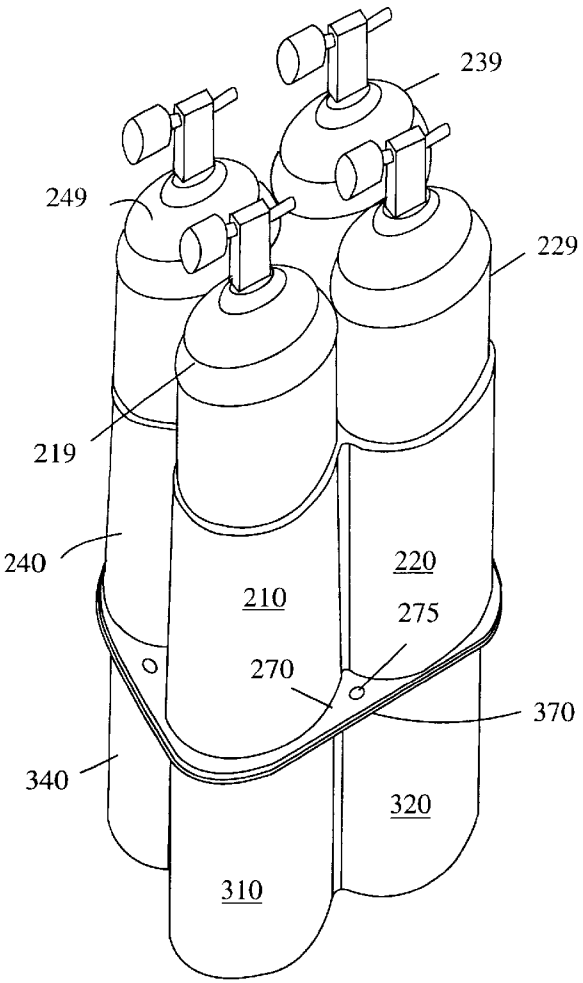
FIG. 11 shows four tank container of FIG. 10 with tanks stored therein.
Figure 10:
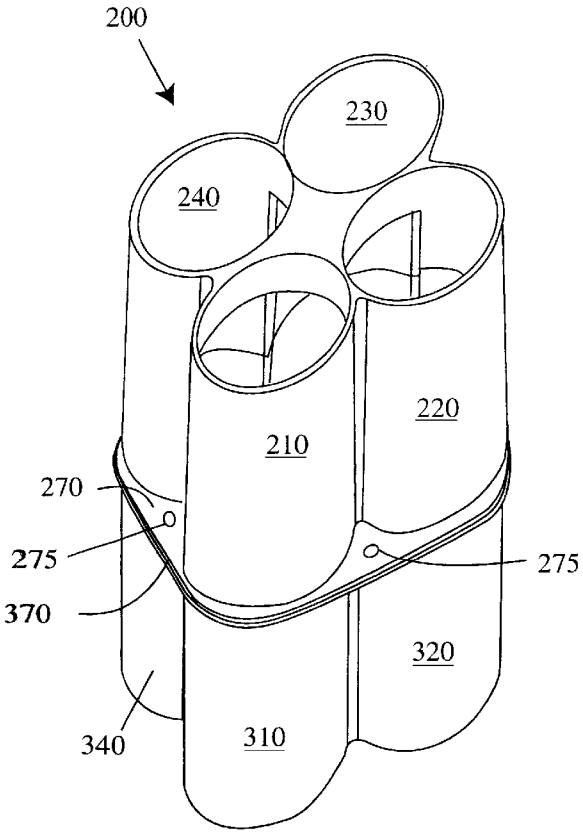
FIG. 10 is a perspective view of an empty rectangular tank storage container for holding four tanks.

FIG. 10 is a perspective view of an empty rectangular tank storage container 200 for holding four tanks. FIG. 11 shows the four tank container of FIG. 10 with tanks 219, 229, 239, 249 stored therein. Storage container 200 includes a top half portion having four hollow cylinders 210, 220, 230, 240 attached to an upper square frame 270, and a bottom half portion having for hollow cylinders 310, 320, 330, 340 attached to another square frame 370, with through-holes 275. The upper cylinders and lower cylinders each have similar dimensions to the cylinders previously described above, and the rectangular frames 270, 370 are also similar to the previously described rectangular frames 70, 170. Divers can find it desirable to use a square four pack container when only a single person is making a dive trip, and/or when space on a pickup truck, boat, garage, home, and the like, is limited.

Figure 13:
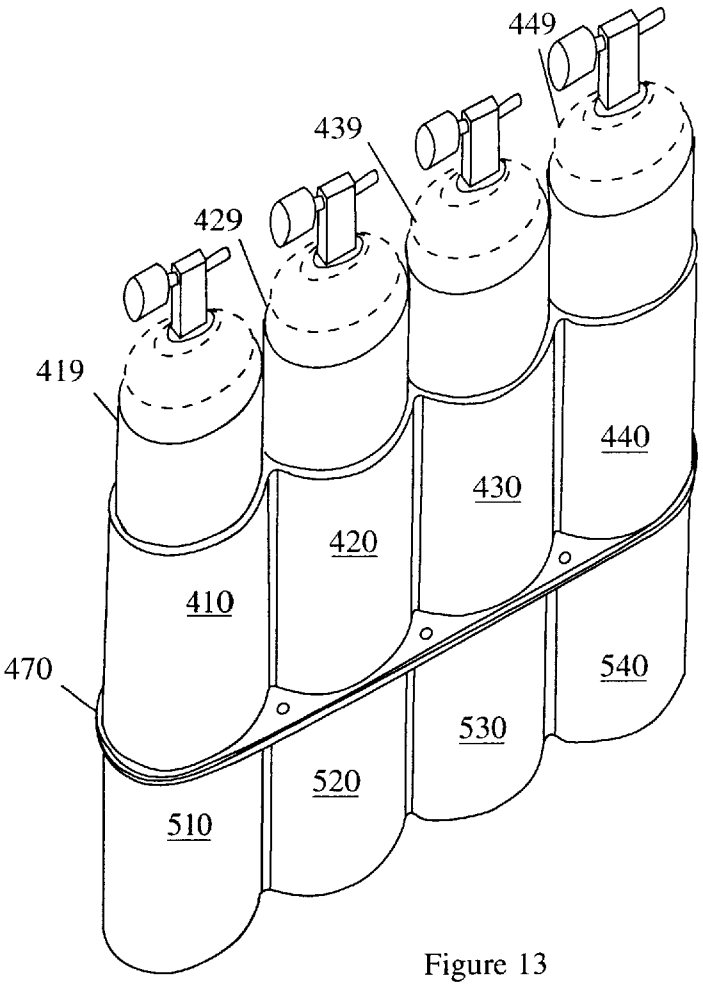
FIG. 13 shows the four tank container of FIG. 12 with tanks stored therein.
Figure 12:
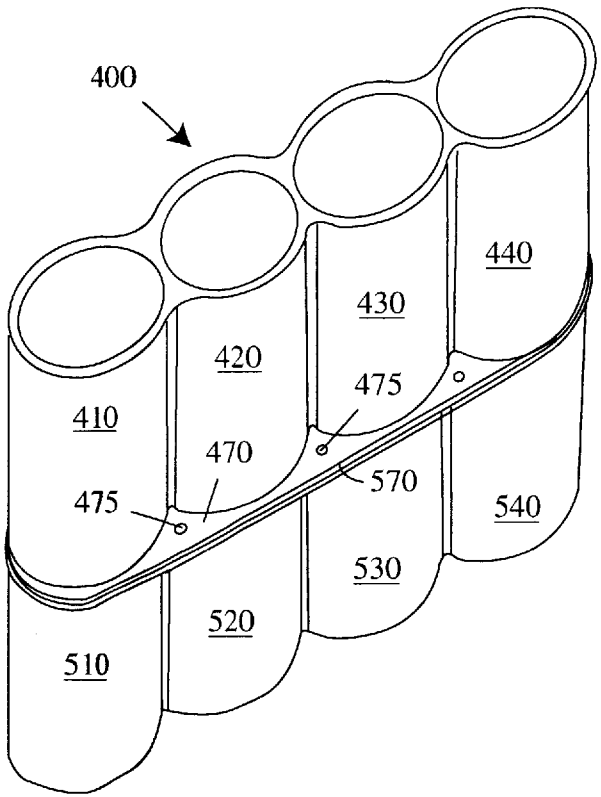
FIG. 12 is a perspective view of an empty side-by-side tank storage container for holding four tanks.

FIG. 12 is a perspective view of an empty side-by-side tank storage container 400 for holding four tanks. FIG. 13 shows the four tank container 400 of FIG. 12 with tanks 419, 429, 439, 449 stored therein. Storage tank container 400 includes a top half portion having four hollow cylinders 410, 420, 430, 440 attached to an upper rectangular frame 470, and a bottom half portion having for hollow cylinders 510, 520, 530, 540 attached to another rectangular frame 570, with through-holes 475 through both frames. The upper cylinders and lower cylinders each have similar dimensions to the cylinders previously described above, and the rectangular frames 470, 570 are also similar to the previously described rectangular. Divers can find it desirable to use a linear line four pack container when only a single person is making a dive trip, and/or when space on a pickup truck, boat, garage, home, and the like, is limited.

Figure 14:
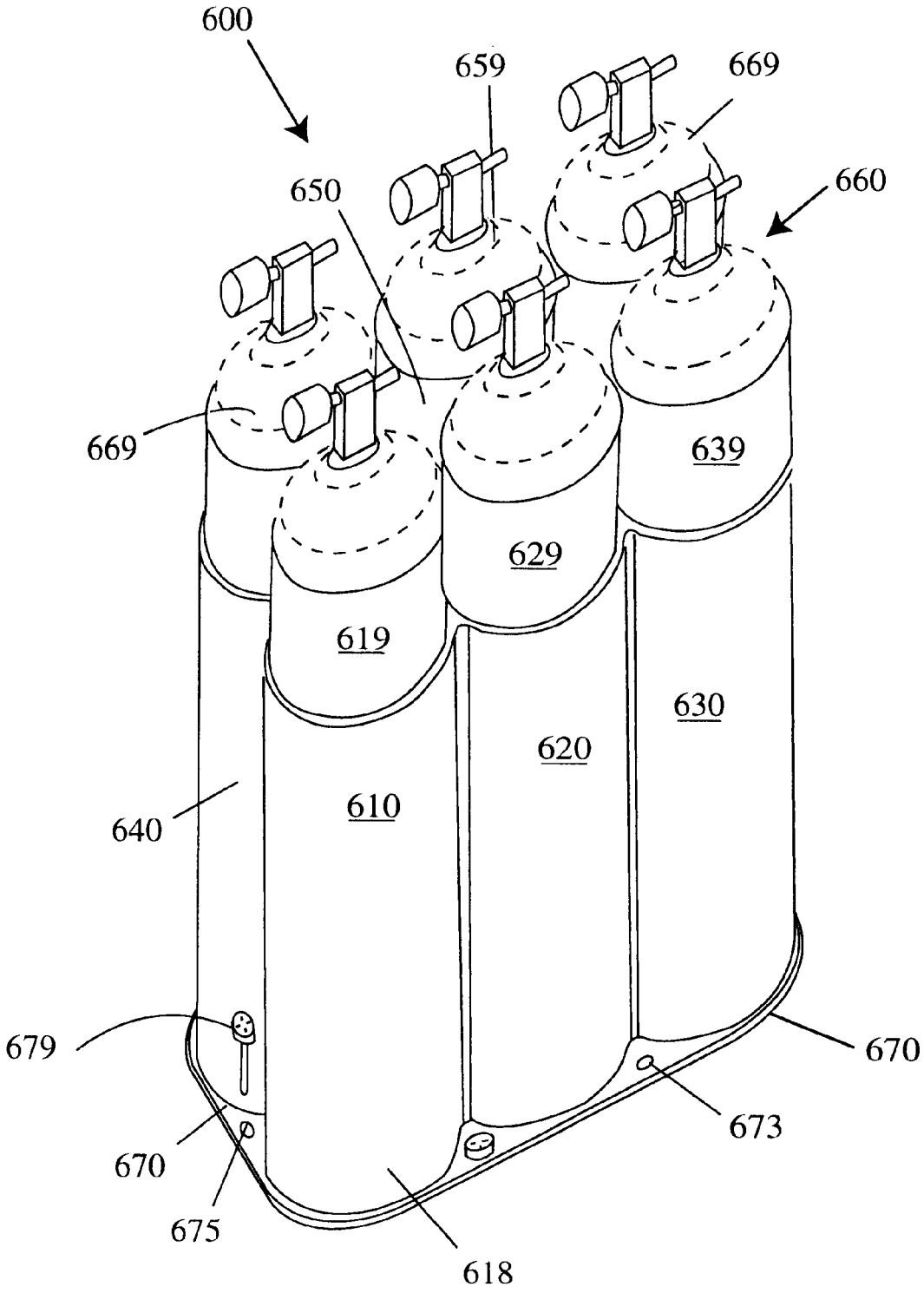
FIG. 14 is a perspective view of another embodiment storage container.

FIG. 14 is a perspective view of another embodiment storage container 600 that can be formed from a single a single mold having individual hollow cylindrical portions 610, 620, 630, 640, 650, 660 for supporting up to six tanks 619, 629, 639, 649, 659, 669. The container 600 can have a bottom planar edge 670 having mounting through-holes 675 therethrough. The interior bottoms(only one 618 is shown for clarity) of each cylindrical portion 610–660 can be a closed bottom or contain through-holes or be completely open to allow excess water to drain out. The container 600 can be attached to flooring of vehicles, garages, and the like by fasteners 679 such as bolts, screws, and the like.

The tank containers can be manufactured in a variety of colors. One type of color for use with pleasure boat applications can be off-white in order to match the base color of many pleasure boats. To extend the life from UV(ultraviolet) rays from sunlight damage, an UV inhibitor agent can be used in plastic molded materials.

Although the preferred embodiments are described for supporting diving tanks, the invention can be used for supporting other types of tanks, such as but not limited to medical oxygen tanks, welding tanks, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A tank storage container for storing cylindrical tanks in vertical upright positions adjacent one another, comprising:

a first cylindrical holder having a bottom closed end and an upper open end;

a second cylindrical holder having a bottom closed end and an upper open end, the second cylindrical holder being adjacent and parallel to the first cylindrical holder;

a third cylindrical holder having a bottom closed end and an upper open end, the third cylindrical holder being adjacent and parallel to the second cylindrical holder;

a fourth cylindrical holder having a bottom closed end and an upper open end, the fourth cylindrical holder being adjacent and parallel to the first cylindrical holder and the third cylindrical holder, wherein the first, the second. the third, and the fourth cylindrical holders are capable of storing cylindrical tanks in vertical positions adjacent to one another and substantially protected from one another; and a frame portion fitted to wrap-around the exterior contours of the first, second, third, and fourth cylindrical holders, the frame portion located adjacent to a midway location between the bottom closed ends and the upper open ends of each of the first, the second, the third, and the fourth cylindrical holders, the frame portion for fastening the cylindrical holders to another structure.

2. The tank storage container of claim 1, further comprising:

a fifth cylindrical holder having a bottom closed end and an upper open end, the fifth cylindrical holder being adjacent and parallel to the third cylindrical holder; and a sixth cylindrical holder having a bottom closed end and an upper open end, the sixth cylindrical holder being adjacent and parallel to the fourth and fifth cylindrical holder, wherein the frame portion further is fitted to wrap-around the exterior contours of the fifth cylindrical holder and the sixth cylindrical holder.

3. The tank storage container of claim 1, wherein the frame portion includes:

through-holes.

4. The tank storage container of claim 3, further comprising:

cord means inserted into the through-holes for fastening the tank storage container to a boat.

5. The tank storage container of claim 3, further comprising:

cord means inserted into the through-holes for fastening the tank storage container within a vehicle.

6. The tank storage container of claim 1, wherein the first cylindrical holder, the second cylindrical holder; the third cylindrical holder, and the fourth cylindrical holder are formed from: plastic.

7. The tank storage container of claim 1, wherein the first cylindrical holder, the second cylindrical holder, the third cylindrical holder, and the fourth cylindrical holder, are each formed from: a top half portion and a bottom half portion.

8. The tank storage container of claim 7, wherein the top half portions and the bottom half portions are welded together.

9. The tank storage container of claim 7, wherein at least one of the top half portions and the bottom half portions has a conical shape.

10. The tank storage container of claim 1, further comprising:

drain holes for allowing excess water to drain out.

11. A tank storage container for storing cylindrical tanks in vertical upright positions adjacent one another, comprising:

a first holder for storing a cylindrical tank having a bottom closed end and an upper open end;

a second holder for storing a cylindrical tank having a bottom closed end and an upper open end, the second cylindrical holder being adjacent and parallel to the first holder; and a fastening portion fitted to wrap-around the exterior contours of the first and the second holders, the fastening portion located adjacent to a midway location between the bottom closed ends and the upper open ends of each the first holder and the second holder, the fastening portion for attaching the first holder and the second holder to another structure, wherein the first holder and the second holder are capable of storing the cylindrical tanks in vertical positions adjacent to one another and substantially protected from one another.

12. The tank storage container of claim 11, further comprising:

a third holder for storing a cylindrical tank, the third holder being adjacent to one of the first holder and the second holder, the first holder and the second holder and the third holder arranged side by side in a straight line, wherein the fastening portion is further fitted to wrap-around the exterior contour of the third holder, the fastening portion located adjacent to a midway location between a bottom closed end and an upper open end of the third holder.

13. The tank storage container of claim 12, further comprising:

a fourth holder for storing a cylindrical tank, the fourth holder being adjacent to one of the first holder and the second holder and the third holder, the first holder and the second holder and the third holder and the fourth holder arranged side by side in a straight line, wherein the fastening portion is further fitted to wrap-around the exterior contour of the fourth holder, the fastening portion located adjacent to a midway location between a bottom closed end and an upper open end of the fourth holder.

14. The tank storage container of claim 11, wherein the fastening portion is a frame portion.

15. The tank storage container of claim 11, wherein the first holder and the second holder are each cylindrical holders.

16. A tank storage container for storing cylindrical tanks in vertical upright positions adjacent one another, comprising:

a first holder for storing a cylindrical tank having a bottom closed end and an upper open end; and a second holder for storing a cylindrical tank having a bottom closed end and an upper open end, the second holder being adjacent and parallel to the first holder, the first holder and the second holder capable of storing the cylindrical tanks in vertical positions separated and protected from one another, the first holder and the second holder are each formed from a top half portion and a bottom half portion, wherein the top half portions and the bottom half portions are welded together.

17. A tank storage container for storing cylindrical tanks in vertical upright positions adjacent one another, comprising:

a first holder for storing a cylindrical tank having a bottom closed end and an upper open end; and a second holder for storing a cylindrical tank having a bottom closed end and an upper open end, the second holder being adjacent and parallel to the first holder, the first holder and the second holder capable of storing the cylindrical tanks in vertical positions separated and protected from one another, the first holder and the second holder are each formed from a top half portion and a bottom half portion, wherein at least one of the top half portions and the bottom half portions has a conical shape.

* * * * *